US010787022B2

(12) United States Patent
Soejima et al.

(10) Patent No.: US 10,787,022 B2
(45) Date of Patent: Sep. 29, 2020

(54) WRITING UTENSIL WITH PRESSURIZING MECHANISM

(71) Applicant: ZEBRA CO., LTD., Tokyo (JP)

(72) Inventors: Eriko Soejima, Tokyo (JP); Tomoaki Koide, Tokyo (JP)

(73) Assignee: ZEBRA CO., LTD., Tokyo (JP)

( * ) Notice: Subject to any disclaimer, the term of this patent is extended or adjusted under 35 U.S.C. 154(b) by 38 days.

(21) Appl. No.: 16/196,139

(22) Filed: Nov. 20, 2018

(65) Prior Publication Data

US 2019/0176509 A1 Jun. 13, 2019

(30) Foreign Application Priority Data

Dec. 8, 2017 (JP) ..... 2017-235970

(51) Int. Cl.

| | |
|---|---|
| ***B43K 7/035*** | (2006.01) |
| ***B43K 7/12*** | (2006.01) |
| ***B43K 7/03*** | (2006.01) |
| ***B43K 24/08*** | (2006.01) |
| ***B43K 5/18*** | (2006.01) |

(52) U.S. Cl.

CPC ..... *B43K 7/035* (2013.01); *B43K 7/03* (2013.01); *B43K 7/12* (2013.01); *B43K 24/08* (2013.01); *B43K 5/18* (2013.01); *B43K 5/189* (2013.01)

(58) Field of Classification Search

CPC . B43K 7/035; B43K 7/03; B43K 7/12; B43K 24/088; B43K 24/08; B43K 5/18; B43K 5/189; B43K 24/084; B43K 5/1818

See application file for complete search history.

(56) References Cited

U.S. PATENT DOCUMENTS

| | | | | |
|---|---|---|---|---|
| 3,415,603 A * | 12/1968 | Blanchard | ..... | B43K 7/12 401/101 |
| 3,420,610 A * | 1/1969 | Malm | ..... | B43K 7/02 401/112 |
| 8,511,925 B2 * | 8/2013 | Noguchi | ..... | B43K 7/03 401/101 |
| 8,801,313 B2 * | 8/2014 | Tomohiro | ..... | B43K 7/10 401/101 |

FOREIGN PATENT DOCUMENTS

| | | |
|---|---|---|
| JP | 2005-138356 | 6/2005 |

* cited by examiner

*Primary Examiner* — David J Walczak
(74) *Attorney, Agent, or Firm* — Greenblum & Bernstein, P.L.C.

(57) ABSTRACT

In a writing utensil with a pressurizing mechanism, a cylinder is provided such that it comes into sliding contact with an outer peripheral part of a valve element and moves back and forth. An inner wall face of the cylinder is provided with a ventilating recess communicating with outside air, and an annular non-pressure contact face is positioned on the rear side of the ventilating recess. When the cylinder moves forwardly, the valve element is brought into pressure contact with the non-pressure contact face to seal the pressurizing chamber and when the cylinder moves backwardly, the valve element is moved forward and is separated from the non-pressure contact face, such that the ventilating recess communicates with the pressurized chamber.

8 Claims, 7 Drawing Sheets

WRITING UTENSIL WITH PRESSURIZING MECHANISM

BACKGROUND OF THE INVENTION

Field of the Invention

The present invention relates to a writing utensil with a pressurizing mechanism that is designed to increase the flow of ink by pressurizing the inside of a refill.

Description of the Related Art

As this type of invention, there has conventionally been known a ballpoint pen, such as the one described in Japanese Patent Application Laid-open No. 2005-138356, which has a shaft tube, a refill stored in the shaft tube so as to be movable back and forth, and a knocking member connected at the rear end side of the refill via a pressurizing mechanism, wherein an air layer formed in the refill at the rear end side is pressurized by the pressurizing mechanism by moving the knocking member back and forth.

The pressurizing mechanism has a tubular holder (piston) connected to a rear end part of the refill so as to be communicated to the inside of the refill, a valve element (O-ring) attached to an outer peripheral part of the holder, and a bottomed, tubular cylinder covering the holder and the valve element from the rear side, wherein a pressurizing chamber is formed at the rear side of the holder within the cylinder, a ventilation passage is formed on the outer peripheral side of the holder to communicate the pressurizing chamber with the outside air, the valve element is provided in the middle of this ventilation passage, and a front end cylinder part that is reduced in diameter is provided at the rear side of an inner peripheral face of the cylinder.

According to this conventional pressurizing mechanism, when the cylinder moves forward relative to the holder, the valve element comes into close contact with the front end cylinder part, thereby sealing the pressurizing chamber, reducing the volume thereof, and consequently pressurizing the inside of a refill. On the other hand, when the cylinder moves backward, a gap is formed around the valve element, and this gap communicates with the ventilation passage and the pressurizing chamber, thereby decompressing the refill.

SUMMARY OF THE INVENTION

However, according to the prior art, the air flows through the relatively narrow gap formed around the ventilation passage and the valve element, so that as foreign matter and the like happen to clog the ventilation passage and the gap, a malfunction or inhibiting smooth decompression (cancelation of pressurization) is caused, and thereby making ink leakage.

In view of these disadvantages, the present invention includes the following constitution.

A writing utensil with a pressurizing mechanism that is configured to pressurize an air layer on a rear end side of a refill stored in a shaft tube, wherein the refill is provided with an annular valve element formed along a rear end opening of the refill, and a cylinder that forms, at a rear side of the valve element, a pressurizing chamber communicating with the air layer, by covering the rear end opening and the valve element from the rear side. The cylinder is provided in such a manner that it comes into sliding contact with an outer peripheral part of the valve element and move back and forth. An inner wall face of the cylinder is provided with a ventilating recess communicating with outside air, and an annular non-pressure contact face positioned on a rear side of the ventilating recess. When the cylinder moves forward, the valve element is brought into pressure contact with the non-pressure contact face to seal the pressurizing chamber. When the cylinder moves backward, the valve element is moved forward and separated from the non-pressure contact face such that the ventilating recess communicates with the pressurizing chamber.

The constitution of the present invention described above can realize smooth decompression after the pressurization.

BRIEF DESCRIPTION OF THE DRAWINGS

FIG. 6A shows a state in which a pressurizing chamber communicates with the outside air, FIG. GB shows a state in which the pressurizing chamber is sealed, and FIG. 6C shows a state in which the pressurizing chamber is compressed.

DESCRIPTION OF THE PREFERRED EMBODIMENT

The present embodiment discloses the following features.

The first feature is a writing utensil with a pressurizing mechanism that is configured to pressurize an air layer on the rear end side of a refill stored in a shaft tube, the refill is provided with an annular valve element formed along a rear end opening of the refill, and a cylinder that forms, at the rear side of the valve element, a pressurizing chamber communicating with the air layer, by covering the rear end opening and the valve element from the rear side. The cylinder is provided in such a manner that it comes into sliding contact with an outer peripheral part of the valve element and move back and forth. An inner wall face of the cylinder is provided with a ventilating recess communicating with outside air, and an annular non-pressure contact face positioned on the rear side of the ventilating recess. When the cylinder moves forward, the valve element is brought into pressure contact with the non-pressure contact face to seal the pressurizing chamber. When the cylinder moves backward, the valve element is moved forward and separated from the non-pressure contact face such that the ventilating recess communicates with the pressurizing chamber (see FIGS. 1 to 6C).

According to this constitution, due to the presence of the ventilating recess formed in the inner wall face of the cylinder, a wide ventilation flow path for decompressing the pressurizing chamber can be secured.

Figure 2:
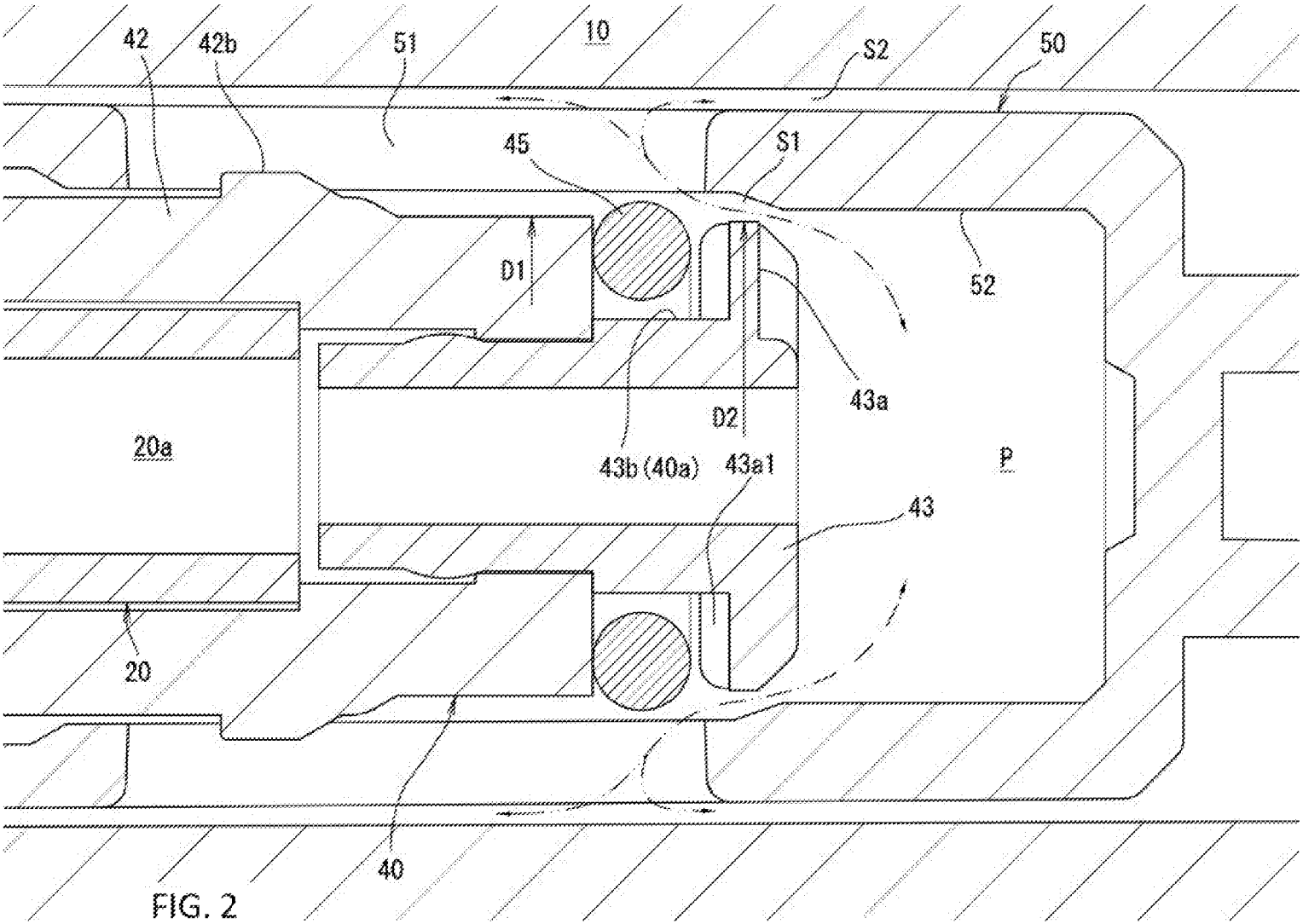
FIG. 2 is an enlarged sectional view showing substantial parts of the writing utensil with the pressurizing mechanism.

In the second feature, for the purpose of more effectively securing the ventilation flow path for decompressing the pressurizing chamber, the ventilating recess is a hole passing through a peripheral wall of the cylinder in a radial direction and communicating with the outside air at an outer peripheral side of the cylinder (see FIG. 2).

In the third feature, for the purpose of obtaining a specific airtight structure, a tubular piston is fixed at the rear end side of the refill, and the valve element is attached annularly to an outer peripheral part of the piston (see FIG. 2).

In the fourth feature, for the purpose of improving the productivity and the like, the outer peripheral part of the piston is provided with an engaging projection protruding radially outward. The piston and the cylinder constitute an integral pressurizing unit by fitting the engaging projection into the ventilating recess so as to move back and forth by a specified distance (see FIG. 7).

In the fifth feature, for the purpose of improving the sealability of the pressurizing chamber, an elastic sealing member for sealing a gap between the piston and the refill is provided at the front side of the valve element (see FIG. 1 and FIGS. 6A to 6C).

Figure 1:
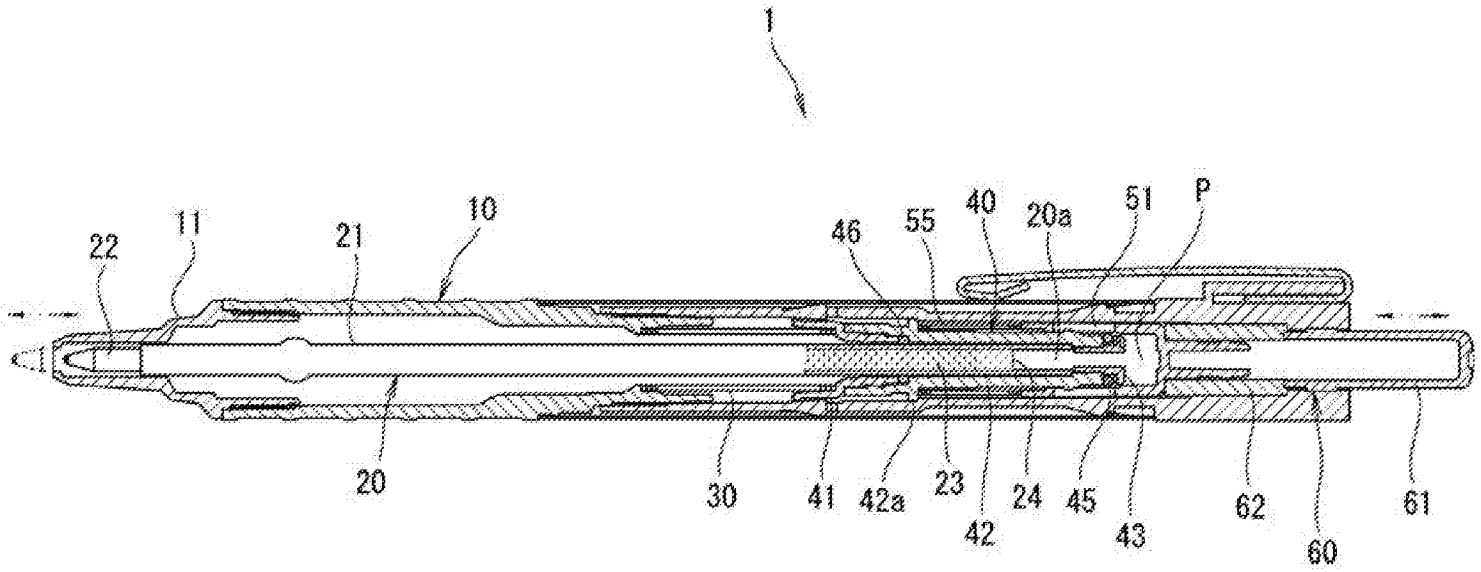
FIG. 1 is a full sectional view showing an example of a writing utensil with a pressurizing mechanism according to the present invention.

The sixth feature is a retractable writing utensil with a pressurizing mechanism that is configured to move the refill forward against urging force of a refill urging member to cause the refill to protrude from a front end of the shaft tube, wherein the refill is attached to the piston in a detachable manner, and the refill urging member has one end side locked to the shaft tube and has the other end side locked to the piston, thereby urging the piston rearward (see FIG. 1).

According to this constitution, it is possible not only to replace the refill promptly without removing the refill urging member, but also to effectively obtain urging force of the refill urging member.

Specific Embodiment

A specific embodiment of the present invention is now described hereinafter with reference to the drawings.

In the following description, the same reference numerals in different diagrams represent substantially the same constitutions; redundant descriptions are omitted accordingly. Furthermore, in the present specification, the term "shaft tube axial direction" means the direction in which the shaft center (centerline) of a shaft tube extends, and the term "shaft tube radial direction" means the direction substantially orthogonal to the shaft tube axial direction.

A writing utensil with a pressurizing mechanism 1 is provided with: a shaft tube 10; a ballpoint pen refill 20 having an air layer 20*a* at the inner rear end side thereof; a refill urging member 30 urging the refill 20 rearward; a piston 40 having the rear end side of the refill 20 inserted therethrough in a detachable manner so as to receive a rear end part of the refill urging member 30; a valve element 45 attached annularly to an outer peripheral part of the piston 40 in such a manner that it follows a rear end opening of the refill 20; an elastic sealing member 46 sealing a gap between the piston 40 and the refill 20 at the front side of the valve element 45; a cylinder 50 that forms, at the rear side of the valve element 45, a pressurizing chamber P communicating with the air layer 20*a*, by covering the rear end opening of the refill 20 and the valve element 45 from the rear side; a cylinder urging member 55 urging the cylinder 50 rearward with respect to the piston 40; and a knocking mechanism 60 for moving the cylinder 50 back and forth by a knocking operation.

This writing utensil with the pressurizing mechanism 1 can be, for example, a ballpoint pen having a colored ink in the refill 20 or a correction pen having a correction liquid in the refill 20.

The shaft tube 10 is an elongated tubular member with front and rear end parts thereof opened. In the illustrated example, the shaft tube 10 connects a plurality of cylindrical elements in an axial direction, and a tapered tubular tip opening 11 is detachably connected to front ends of these cylindrical elements.

The refill 20 is stored in this shaft tube 10 in such a manner that it moves back and forth.

The refill 20 has an elongated cylindrical ink storing tube 21, a ballpoint pen tip 22 connected to a front end part of the ink storing tube 21, an ink 23 stored in the front section of the ink storing tube 21, and a follower 24 stored at the rear side of the ink 23. The air layer 20*a* is secured at the rear side of the follower 24 in the ink storing tube 21.

The ink 23 may be a colored ink of a ballpoint pen, a whiteout of a correction pen, or the like.

The follower 24 is a well-known grease-like liquid, and moves forward as the level of the ink 23 drops as writing progresses. The follower 24 can also be a cylindrical solid.

The refill 20 having the foregoing constitution is inserted and detachably fitted into the piston 40 described hereinafter.

The refill urging member 30 is a compression coil spring.

This refill urging member 30 is attached annularly to the periphery of the refill 20 at the rear side of the center of the entire length of the refill 20. A front end part of the refill urging member 30 is locked to the shaft tube 10, and a rear end part of the same is locked to a receiving member 41 of the piston 40, thereby urging the piston 40 and the refill 20 rearward.

The piston 40 is integrally constituted by the receiving member 41 receiving the rear end part of the refill urging member 30, a piston main body 42 connected to the rear side of the receiving member 41, and a valve element holding member 43 connected to the rear side of the piston main body 42. These members constituting the piston 40 can be formed partly or entirely from a single member.

The receiving member 41 is formed into a cylinder having a stepped part in an inner wall face thereof, and receives the rear end of the refill urging member 30 by means of this stepped part.

Figure 4A:
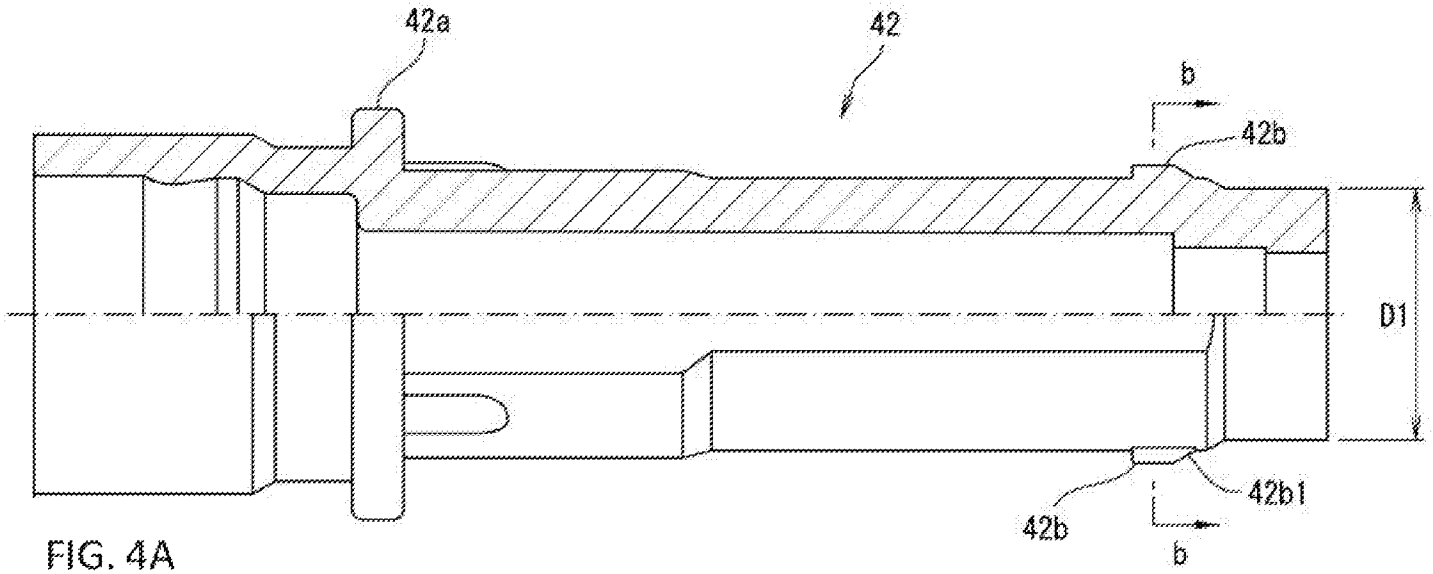
FIG. 4A is a half sectional view showing an example of a front-side member of a piston and FIG. 4B is a full sectional view taken along line b-b of FIG. 4A.
Figure 4B:
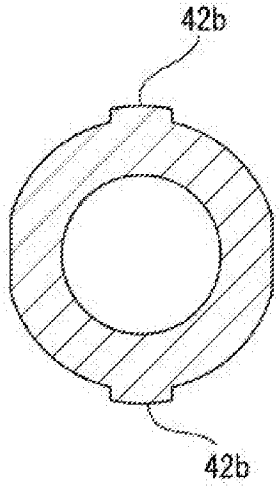

As shown in FIGS. 4A and 4B, the piston main body 42 is formed in a substantially tubular shape, wherein the receiving member 41 is fitted immovably to an inner peripheral face of the piston main body 42 at the front end side, and the valve element holding member 43 is fitted immovably to an inner peripheral face of the piston main body 42 at the rear end side.

A flange part 42*a* receiving a front end part of the cylinder urging member 55 protrudes in an annular shape on an outer periphery of the piston main body 42 at the front end side.

A plurality of engaging projections 42*b* (two, equally spaced, in the illustrated example), which are fitted into to ventilating recesses 51 of the cylinder 50 in such a manner that it is movable back and forth, are provided at the rear end side of the piston main body 42.

Each of the engaging projections 42*b* protrudes radially outward and has a slant face 42*b*1 in a rear end part thereof. The slant face 42*b*1 rides over the cylinder 50 and is fitted when mounting the cylinder 50 on the rear side of the piston 40.

A tubular section on the rear end side of the piston main body 42 protrudes farther rearward from a rear end part of the ink storing tube 21, extending the air layer 20*a* in the ink storing tube 21 rearward.

Figure 5A:
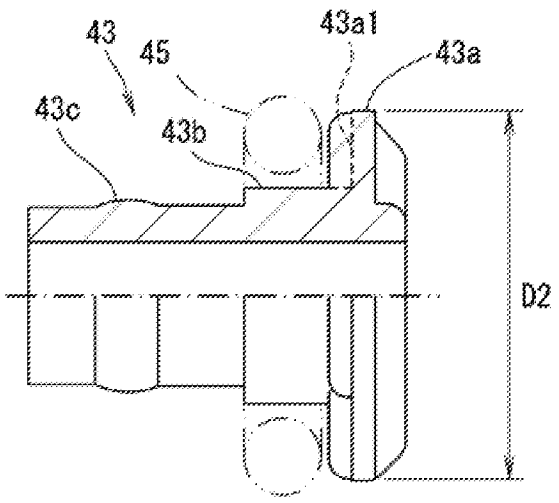
FIG. 5A is a half sectional view showing an example of a rear-side member of the piston and FIG. 5B is a diagram of the rear-side member viewed from the front.
Figure 5B:
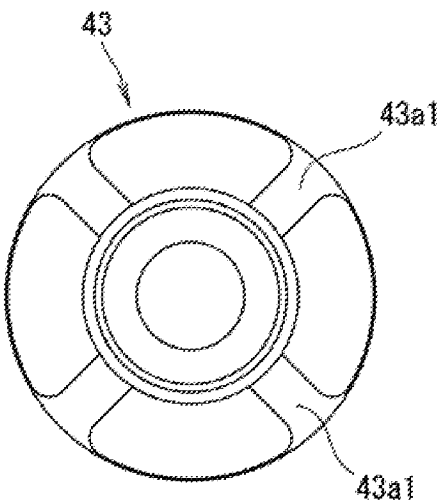

As shown in FIGS. 5A and 5B, the valve element holding member 43 is formed in a substantially tubular shape having the flange part 43*a* at the rear end side thereof and has a valve element attaching part 43*b* at the front side of the flange part 43*a*, the valve element attaching part 43*b* having the valve element 45 fitted thereto. The valve element holding member 43 also has a connecting part 43*c* at the front side of the valve element attaching part 43*b*, the connecting part 43*c* being fitted and connected to the piston main body 42.

The flange part 43*a* is formed in an annular shape, stretching over the entire circumference of the valve element holding member 43. A plurality of ventilating grooves 43*a*1 are provided at intervals in a circumferential direction on a front face and/or a rear face of the flange part 43*a*. These ventilating grooves 43*a*1 improve the distribution of air in the vicinity of the valve element 45. As shown in FIG. 2, the outer diameter D2 of the flange part 43*a* is set to be smaller than the outer diameter D1 of the rear end side of the piston main body 42, to appropriately secure a ventilation passage at the rear side of the valve element 45.

The valve element attaching part 43*b* is formed into a cylindrical plane, the outer diameter of which is smaller than the inner diameter of the valve element 45.

The valve element holding member 43 having the foregoing constitution is connected integrally to the rear end side of the piston main body 42. An annular recess 40*a* (see FIG. 2) for fitting the valve element 45 thereto is constituted by the valve element attaching part 43*b*, the front face of the flange part 43*a*, and a rear end face of the piston main body 42.

The valve element 45 is an O-ring made out of an elastic material such as rubber.

As shown in FIG. 2, an outer peripheral part of the valve element 45 protrudes radially outward of an outer peripheral face of the piston main body 42 at the rear end side. In other words, the outer diameter of the valve element 45 is larger than the rear end side outer diameter D1 of the piston main body 42.

The front-rear width of the valve element 45 is set to be narrower than that of the annular recess 40*a* so that the valve element 45 slightly moves back and forth in the annular recess 40*a*.

According to the illustrated example, the elastic sealing member 46 is an O-ring made out of an elastic material such as rubber.

The elastic sealing member 46 is fitted annularly into a stepped part formed in a front-side inner peripheral face of the piston main body 42 (see FIGS. 6A to 6C), and elastically deforms between the inner peripheral face of the piston main body 42 and an outer peripheral face of the refill 20.

This constitution can close an air passage extending from the gap between the inner peripheral face of the piston main body 42 and the outer peripheral face of the refill 20 to the outside, improving the airtightness of the pressurizing chamber P.

Figure 3A:
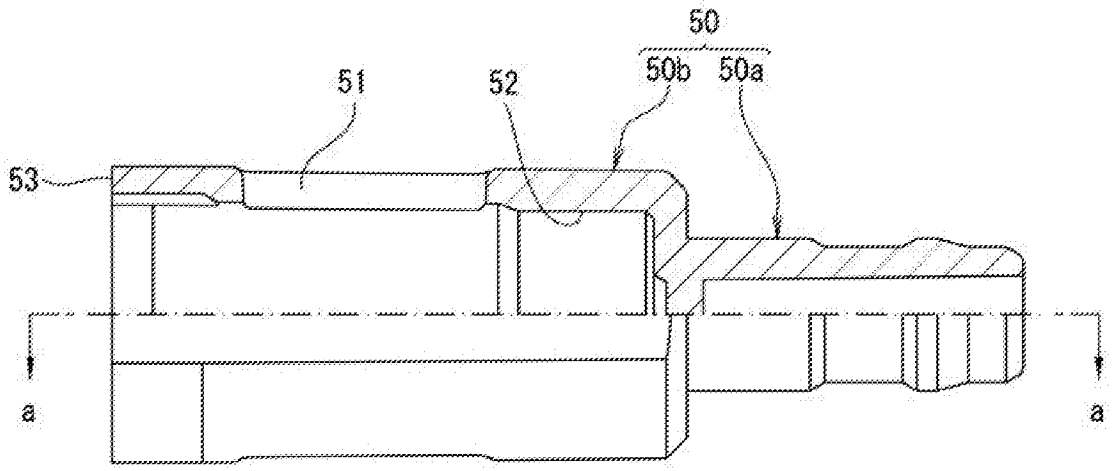
FIG. 3A is a half sectional view showing an example of a cylinder and FIG. 3B is a full sectional view taken along line a-a of FIG. 3A.
Figure 3B:
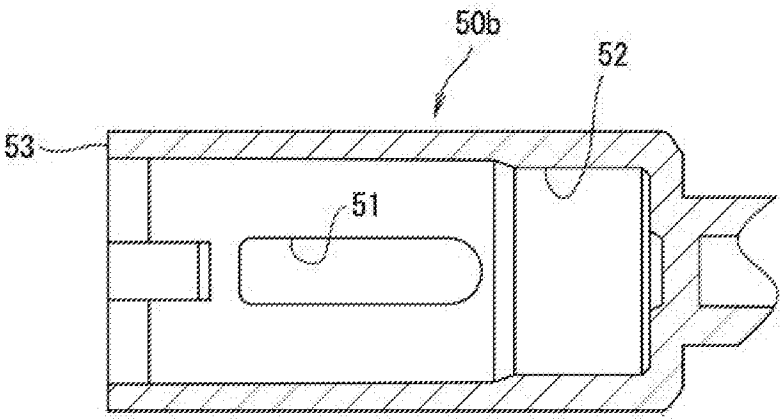

As shown in FIG. 3A, the cylinder 50 is constituted by a knocking mechanism engaging part 50*a* provided at the rear side and a cylinder main body part 50*b* provided at the front side.

The knocking mechanism engaging part 50*a* is formed in the shape of a shaft protruding rearward, wherein a rotor 62 of the knocking mechanism 60 is fitted in a rotatable manner and in such a manner that it is unmovable back and forth, by an annular uneven part formed on an outer peripheral face of the knocking mechanism engaging part 50*a*.

A cylinder main body part 50*b* is formed in the shape of a bottomed tube that covers the valve element 45 and the piston 40 from the rear side in such a manner that the cylinder main body part 50*b* moves back and forth by having an inner peripheral face thereof in sliding contact with the outer peripheral part of the valve element 45.

A peripheral wall of the cylinder main body part 50*b* is provided with the ventilating recesses 51 communicating with the outside air and an annular non-pressure contact face 52 positioned on the rear side of the ventilating recesses 51. A front end face of the cylinder main body part 50*b* functions as a receiving face 53 receiving a rear end of the cylinder urging member 55.

The ventilating recesses 51 are each a long hole passing through the peripheral wall of the cylinder main body part 50*b* in the shaft tube radial direction and extending in the shaft tube axial direction.

The space inside each ventilating recess 51 communicates with the outside via a gap on an outer periphery of the cylinder main body part 50*b*. Specifically, the gap between an outer peripheral face of the cylinder main body part 50*b* and an inner peripheral face of the shaft tube 10, at the front side thereof, extends forward in a continuous manner through the gaps around the cylinder urging member 55, the receiving member 41, the refill urging member 30, and the refill 20, and communicates with the outside via a front end opening of the shaft tube 10 (see FIG. 1). Furthermore, the gap, at the rear side thereof, extends rearward in a continuous manner through the gap around the knocking mechanism 60 and communicates with the outside via a rear end opening of the shaft tube 10.

The inner diameter of the section of the cylinder main body part. 50*b* that has the ventilating recesses 51 is set to be larger than the outer diameter of the valve element 45 (see FIG. 2). Therefore, in a case where the valve element 45 is positioned near the ventilating recesses 51 side, an air passage to communicate with the outside air is formed around the valve element 45.

The non-pressure contact face 52 is a tubular inner face positioned at the rear side of the ventilating recesses 51. The non-pressure contact face 52 is smaller in diameter than the inner diameter of the section of the cylinder main body part 50*b* that has the ventilating recesses 51, and the inner diameter of the non-pressure contact face 52 is set to be smaller than the maximum diameter of the valve element 45 (see FIG. 2).

Figure 6A:
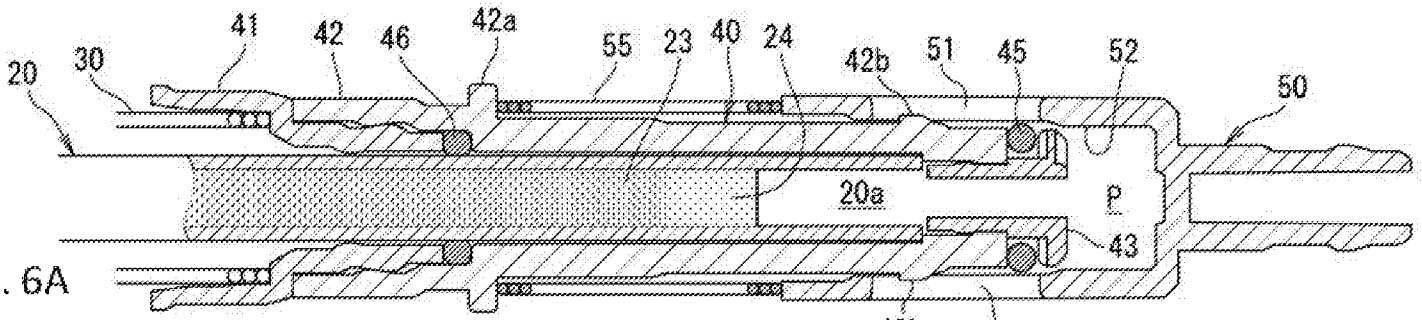
FIG. 6A, FIG. 6B and FIG. 6C are full sectional views showing substantial parts of the writing utensil with the pressurizing mechanism, where
Figure 6B:
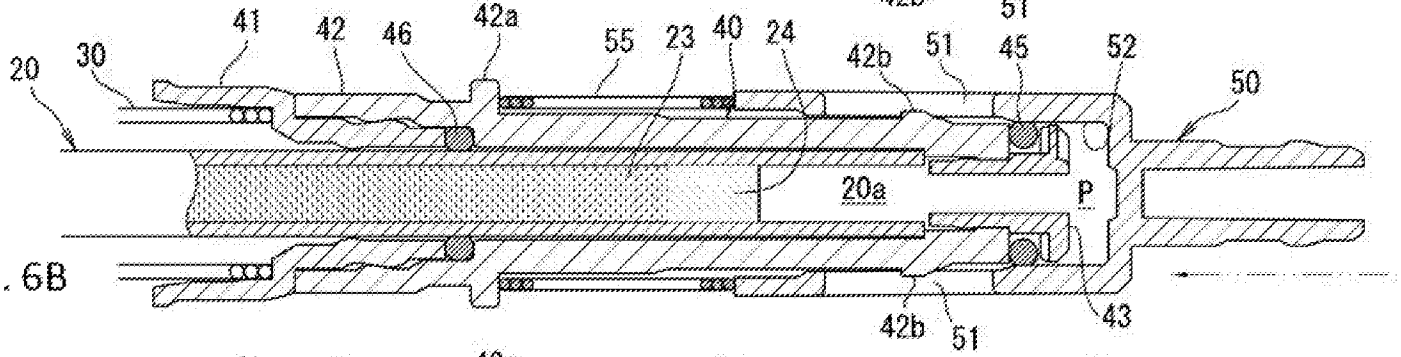

Therefore, when the cylinder 50 moves forward, the non-pressure contact face 52 is brought into pressure contact with an outer periphery side of the valve element 45, thereby sealing the pressurizing chamber P formed at the rear side of the valve element 45 (see FIG. 6B).

The cylinder urging member 55 is a compression coil spring having a weaker urging force than the refill urging member 30.

The cylinder urging member 55 is attached annularly to the outer peripheral part of the piston 40, and urges the cylinder 50 rearward relative to the piston 40 at a rear half part in the shaft tube 10 by having a front end of the cylinder urging member 55 in abutment with the flange part 42*a* and a rear end of the same in abutment with a front end part of the cylinder 50.

The knocking mechanism 60 is a mechanism that moves the cylinder 50 forward by a specified distance using forward pressing force applied from the outside, to lock the cylinder 50, and releases this locked state using the forward pressing force applied again. The knocking mechanism 60 can be any well-known mechanism such as the knocking mechanism described in Japanese Patent Application Laid-open No. 2005-138356.

The knocking mechanism 60 in the illustrated example has a knocking member 61 protruding rearward from a rear end of the shaft tube 10 and having a cam slant face at a front end part of the knocking member 61, the rotor 62 that comes into abutment with a front end part of the knocking member 61 and moves back and forth integrally with the knocking member 61, and a guide groove (not shown) and a cam slant face (not shown) that are formed in the inner peripheral face of the shaft tube 10. The knocking mechanism 60 rotates the rotor 62 by a specified amount and locks the rotor 62 by moving the knocking member 61 forward by a specified distance, and releases this locked state by moving the knocking member 61 forward again.

Next, the characteristic effects of the writing utensil with the pressurizing mechanism 1 having the foregoing constitution are described in detail.

In the stored state in which the ballpoint pen tip 22 is placed inside the shaft tube 10 (see FIG. 1), the cylinder 50 is moved backward by the urging force of the cylinder urging member 55 and is in pressure contact with a front end face of the rotor 62. In this state, as shown in FIG. 2, the pressurizing chamber P to communicate with the air layer 20*a* of the refill 20 is secured in the cylinder 50 at the rear side of the piston 40. This pressurizing chamber P communicates in a front-rear direction in the shaft tube 10 via a gap S1 around the rear end side of the piston 40, the spaces inside the ventilating recesses 51, a gap S2 around the cylinder 50, and the like, and further communicates with the outside air via the front and rear end openings of the shaft tube 10. Thus, in this communication state, the inside of the pressurizing chamber P is at atmospheric pressure.

Next, when the cylinder 50 moves forward against the urging force of the cylinder urging member 55 due to forward pressing force applied to the knocking member 61, the entire circumference of the non-pressure contact face 52 of the cylinder 50 is brought into pressure contact with the valve element 45, creating a sealed state of the pressurizing chamber P at the rear side of the valve element 45, as shown in FIG. 6B.

Figure 6C:
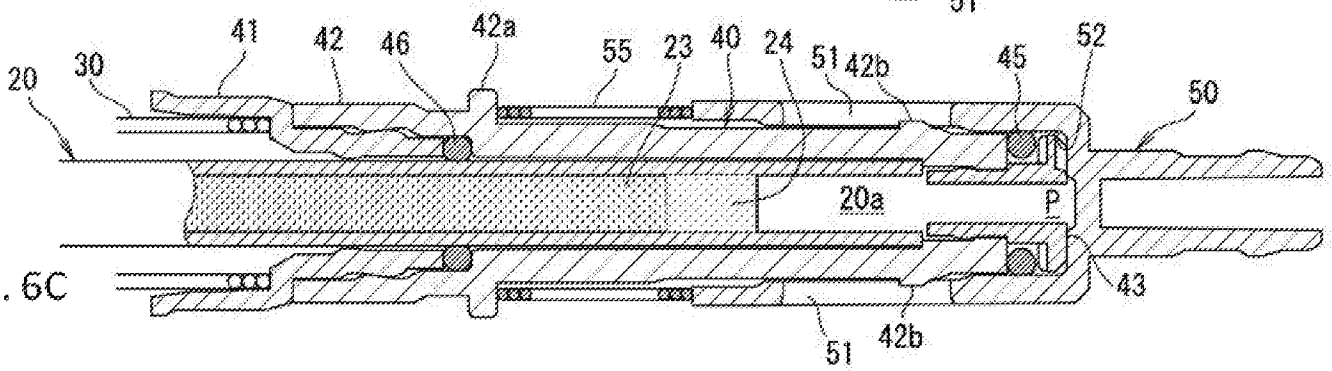

Furthermore, when the knocking member 61 moves forward, the volume of the pressurizing chamber P becomes smaller as shown in FIG. 6C, compressing the air inside the pressurizing chamber P and the air layer 20*a*.

When the knocking member 61 moves further forward, a bottom face inside the cylinder main body part 50*b* comes into abutment with the rear end of the piston 40 (precisely, a rear end of the valve element holding member 43), integrally moving the cylinder 50, the piston 40, the refill 20 and the like forward against the urging force of the refill urging member 30. As a result, a writing tip part of the ballpoint pen tip 22 protrudes from the front end of the shaft tube 10 and the rotor 62 rotates and then is locked to a locking part (not shown) on the inner peripheral face of the shaft tube 10.

In this protrusion state, the ink 23 and the follower 24 in the refill 20 are pushed forward by the compressed air layer 20*a*, increasing the flow of the ink 23 that is ejected from the ballpoint pen tip 22 at the time of writing.

Next, when the knocking member 61 moves forward again by the knocking operation, the rotor 62 is removed from the locking part that is not shown, and then moves backward. Consequently, the writing tip part of the ballpoint pen tip 22 is placed inside the shaft tube 10, the cylinder 50 is moved backward by the urging force of the cylinder urging member 55, the valve element 45 moves relatively forward to separate from the non-pressure contact face 52, the ventilating recesses 51 communicates with the pressurizing chamber P, and the inside of the pressurizing chamber P communicates with the outside air (see FIG. 2 and FIG. 6A).

At this moment, the air inside the pressurizing chamber P passes through relatively wide space such as the gap S1 around the flange part 43*a*, the ventilating grooves 43*al* on the front face and/or the rear face of the flange part 43*a*, and the ventilating recesses 51. Accordingly, it becomes easy to avoid clogging of foreign matter and the like in the air flow passage.

According to the writing utensil with the pressurizing mechanism 1, the inside of the pressurizing chamber P can be decompressed (cancelation of pressurization) smoothly, preventing ink leakage caused by poor decompression.

In addition, since a relatively wide air passage is secured by the ventilating recesses 51, the size for securing the gap between the piston 40 and the cylinder 50 can be set large, leading to easy part management and productivity improvement.

Also, since the refill urging member 30 is provided integrally with the shaft tube 10 away from the refill 20 at the rear half part in the shaft tube 10, rearward urging force of the refill urging member 30 can be obtained effectively, to reduce the frictional resistance and rubbing noise caused by contraction of the refill urging member 30. Furthermore, favorable workability is achieved when removing the tip opening 11 to replace the refill 20, since the refill urging member 30 does not fall off.

Figure 7:
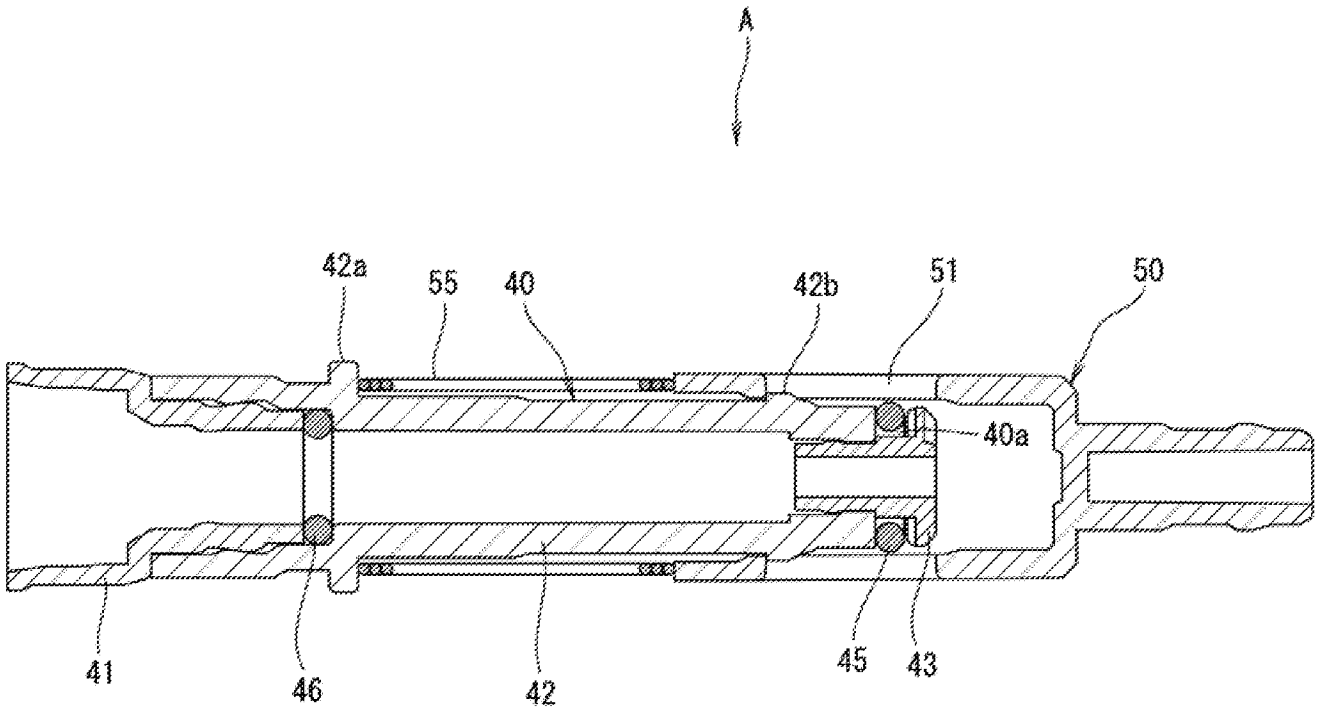
FIG. 7 is a full sectional view showing an example of a pressurizing unit.

As shown in FIG. 7, the writing utensil with the pressurizing mechanism 1 can also integrally constitute a pressurizing unit A that moves the cylinder 50 back and forth with respect to the piston 40 by a specified distance by means of the engagement between the engaging projections 42*b* and the ventilating recesses 51.

Specifically, the pressurizing unit A shown in FIG. 7 is integrally constituted by connecting the piston main body 42 to the rear end of the receiving member 41 via the elastic sealing member 46, connecting the valve element holding member 43 to the rear end side of the piston main body 42, attaching the cylinder urging member 55 annularly to the rear side of the flange part 42*a* of the piston main body 42, attaching the valve element 45 annularly to the annular recess 40*a* between the piston main body 42 and the valve element holding member 43, thereafter attaching the cylinder 50 in such a manner that it covers the piston main body 42, the valve element 45, and the valve element holding member 43 from the rear side, and fitting the engaging projections 42*b* into the respective ventilating recess 51.

According to this pressurizing unit A, since the valve element. 45 does not protrude toward the outer peripheral side of the cylinder 50, foreign matter such as contaminants can be prevented from attaching to the valve element 45, preventing deterioration of pressurizing performance due to the attachment of the foreign matter.

Even when poor assembly occurs where, for example, the cylinder urging member 55 is held between the piston main body 42 and the cylinder 50, such poor assembly can visually be detected easily before the pressurizing unit A is stored in the shaft tube 10; consequently, the defect rate can be reduced.

Moreover, the workability of the process of assembling the writing utensil with the pressurizing mechanism 1 is favorable because the integral pressurizing unit A simply needs to be inserted into the shaft tube 10.

In the foregoing embodiment, the ventilating recesses 51 are each configured as a through hole extending in the radial direction. However, each of the ventilating recesses 51 may only need to be formed in a concave shape in an inner peripheral face of the cylinder 50 and communicate with the outside air. In another example, the ventilating recesses 51 can each be a recessed groove that is formed in an inner peripheral face of the cylinder main body part 50*b* but does not pass through a peripheral wall thereof. The ventilating recesses 51 (recessed grooves) according to this aspect may only need to extend forward along the inner peripheral face of the cylinder main body part 50*b* in order to communicate with the outside of the shaft tube 10.

In the foregoing embodiment, the writing utensil with the pressurizing mechanism 1 is constituted as a ballpoint pen or a correction pen but can be applied to writing utensils other than the ones illustrated, such as a marker.

In the foregoing embodiment, the valve element 45 is attached at the rear end side of the refill 20 via the piston 40, which is a particularly preferred constitution, but another constitution is possible in which the valve element 45 is fitted annularly directly the rear end side of the refill 20 without using the piston 40, and the cylinder 50 is provided therearound.

In the foregoing embodiment, the gap between the piston 40 and the refill 20 is closed by the elastic sealing member 46, which is a particularly preferred constitution, but another constitution is possible in which the gap is closed by an annular projection provided in the inner peripheral face of the piston 40 without using the elastic sealing member 46, or in which the gap is closed by an adhesive.

Although the foregoing embodiment constitutes a retractable writing utensil, another form of writing utensil is possible in which the refill is fixed to the shaft tube in a non-retractable manner and the pressurizing mechanism (the pressurizing unit A or the like) having the constitution described above is provided inside this shaft tube.

The present invention is not limited to the foregoing embodiment and can be appropriately modified without changing the gist of the present invention.

REFERENCE SIGNS LIST

1 Writing utensil with pressurizing mechanism
10 Shaft tube
20 Refill
20*a* Air layer
30 Refill urging member
40 Piston
40*a* Annular recess
42 Piston main body
42*b* Engaging projection
43 Valve element holding member
45 Valve element
46 Elastic sealing member
50 Cylinder
51 Ventilating recess
52 Non-pressure contact face
55 Cylinder urging member
60 Knocking mechanism
P Pressurizing chamber

What is claimed is:

1. A writing utensil with a pressurizing mechanism includes a shaft tube with a refill stored in the shaft tube, the writing utensil with a pressurizing mechanism is configured to pressurize an air layer on the rear end side of the refill stored in the shaft tube, wherein the refill is provided with an annular valve element provided along a rear end opening of the refill, and a cylinder that provides, at a rear side of the valve element, a pressurizing chamber communicating with the air layer, by covering the rear end opening and the valve element from the rear side, the cylinder is provided such that it comes into sliding contact with an outer peripheral part of the valve element and moves back and forth, an inner wall face of the cylinder is provided with a ventilating recess communicating with outside air, and an annular non-pressure contact face is positioned on a rear side of the ventilating recess, and when the cylinder moves forward, the valve element is brought into pressure contact with the non-pressure contact face to seal the pressurizing chamber, and when the cylinder moves backward, the valve element is moved forward with respect to the non-pressure contact face of the cylinder such that the ventilating recess communicates with the pressurizing chamber, and the ventilating recess comprises a hole passing through a peripheral wall of the cylinder in a radial direction and communicates with the outside air at an outer peripheral side of the cylinder.

2. The writing utensil with a pressurizing mechanism according to claim 1, wherein a tubular piston is positioned at the rear end side of the refill, and the valve element is annularly attached about an outer peripheral part of the tubular piston.

3. The writing utensil with a pressurizing mechanism according to claim 2, wherein the outer peripheral part of the tubular piston is provided with an engaging projection protruding radially outward, and the engaging projection fits into the ventilating recess so as to move back and forth by a specified distance, such that the tubular piston and the cylinder comprise an integral pressurizing unit.

4. The writing utensil with a pressurizing mechanism according to claim 2, wherein an elastic sealing member, that seals a gap between the tubular piston and the refill, is provided forwardly of the valve element.

5. The writing utensil with a pressurizing mechanism according to claim 1, which is retractable and configured to move the refill forward against an urging force of a refill urging member to cause the refill to protrude from a front end of the shaft tube, wherein the refill is detachably attached to the tubular piston, and the refill urging member has one end side locked to the shaft tube and has the other end side locked to the tubular piston, thereby urging the tubular piston rearward.

6. A writing utensil with a pressurizing mechanism comprising:

a shaft tube and a refill stored in the shaft tube, wherein the writing utensil with a pressurizing mechanism is configured to pressurize an air layer on a rear end side of the refill, the refill includes an annular valve element provided along a rear end opening of the refill, and a cylinder that provides, at a rear side of the valve element, a pressurizing chamber communicating with the air layer, by covering the rear end opening and the valve element from the rear side, the cylinder is configured such that it comes into sliding contact with an outer peripheral part of the valve element and moves back and forth, an inner wall face of the cylinder is provided with a ventilating recess communicating with outside air, and an annular non-contact face is positioned on a rear side of the ventilating recess, a tubular piston is positioned at a rear end side of the refill, and the valve element is annularly attached about an outer peripheral part of the tubular piston, the outer peripheral part of the tubular piston is provided with an engaging projection that protrudes radially outward, the engaging projection fits into the ventilating recess so as to move backward and forward by a specified distance, such that the tubular piston and the cylinder comprise an integral pressurizing unit, and when the cylinder moves forwardly, the valve element is brought into pressure contact with the non-pressure contact face to seal the pressurizing chamber, and when the cylinder moves backwardly, the valve element is moved forward with respect to the non-pressure contact face of the cylinder such that the ventilating recess communicates with the pressurizing chamber.

7. The writing utensil with a pressurizing mechanism according to claim 6, wherein an elastic sealing member, that seals a gap between the tubular piston and the refill, is provided forwardly of the valve element.

8. The writing utensil with a pressurizing mechanism according to claim 6, which is retractable and configured to move the refill forwardly against the urging force of a refill urging member to cause the refill to protrude from a front end of the shaft tube, wherein the refill is detachably attached to the tubular piston, and the refill urging member has one end side locked to the shaft tube and has another end side locked to the tubular piston, thereby urging the tubular piston rearwardly.

* * * * *